United States Patent [19]

Simonds et al.

[11] Patent Number: 4,461,267

[45] Date of Patent: Jul. 24, 1984

[54] COMPOUND BOW

[75] Inventors: Gary Simonds, Gainesville; Robert Remick, Rosewood; Gerald Hayes, Gainesville, all of Fla.

[73] Assignee: Kidde Reaction Products, Inc., North Brook, Ill.

[21] Appl. No.: 402,245

[22] Filed: Jul. 27, 1982

[51] Int. Cl.[3] ..... F41B 5/00

[52] U.S. Cl. ..... 124/23 R; 124/88; 124/DIG. 1

[58] Field of Search ..... 124/23 R, 24 R, 88, 124/90, DIG. 1

[56] References Cited

U.S. PATENT DOCUMENTS

| | | | |
|---|---|---|---|
| 3,744,473 | 7/1973 | Nishioka | 124/24 |
| 3,851,638 | 12/1974 | Alexander | 124/24 R |
| 3,854,467 | 12/1974 | Hofmeister | 124/24 R |
| 3,967,609 | 7/1976 | Frydenlund | 124/24 R |
| 3,987,777 | 10/1976 | Darlington | 124/23 R |
| 4,060,066 | 11/1977 | Kudlacek | 124/23 R |
| 4,061,125 | 12/1977 | Trotter | 124/88 X |
| 4,077,385 | 3/1978 | Fredrickson | 124/24 R |
| 4,178,905 | 12/1979 | Groner | 124/23 R |
| 4,201,177 | 5/1980 | Holman et al. | 124/23 R |
| 4,287,867 | 9/1981 | Islas | 124/24 R |
| 4,368,718 | 1/1983 | Simonds et al. | 124/23 R |

*Primary Examiner*—Richard J. Apley
*Assistant Examiner*—William R. Browne
*Attorney, Agent, or Firm*—Emory L. Groff, Jr.

[57] ABSTRACT

A compound bow includes a pair of improved pivotally mounted cam assemblies having separate, specification profiled string cable segments and power cable segments constructed and arranged to produce a draw force curve representing a greater area of stored energy than that obtained with most existing compound bows. The draw length of the bow, among other parameters, is readily altered without compressing and dismantling the bow cable components by removing and replacing differently configured draw length cam modules associated with the power cable segments. Attachment and subsequent turning of each of the timing, string and power cables is easily accomplished by means of cable adjusters carried by each cam assembly.

22 Claims, 20 Drawing Figures

FIG. 3.
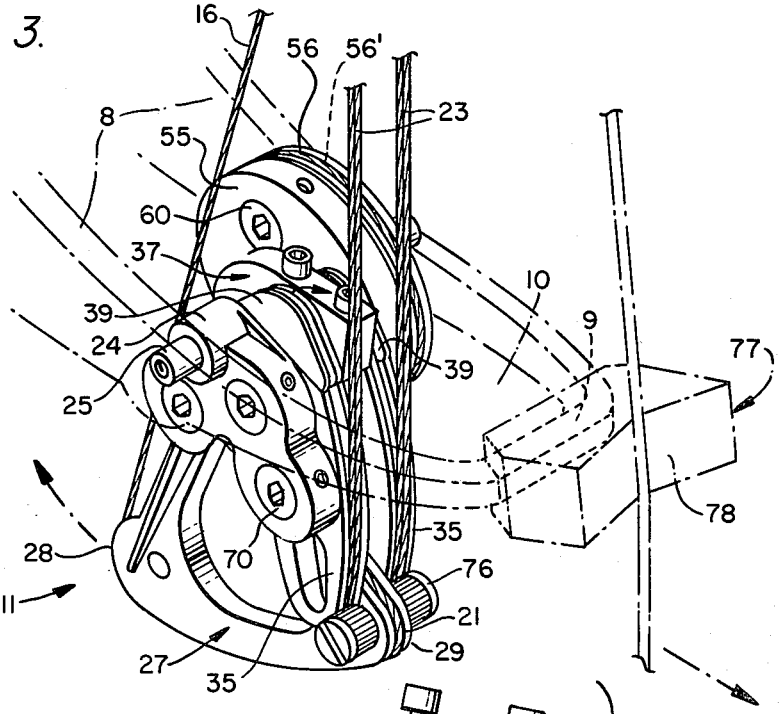
FIG. 4A.
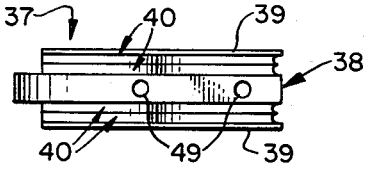
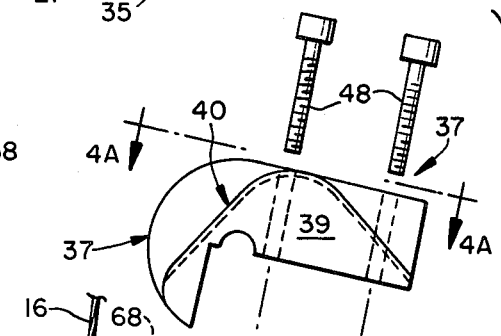
FIG. 4.
FIG. 4B.
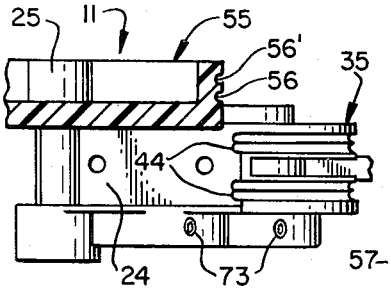
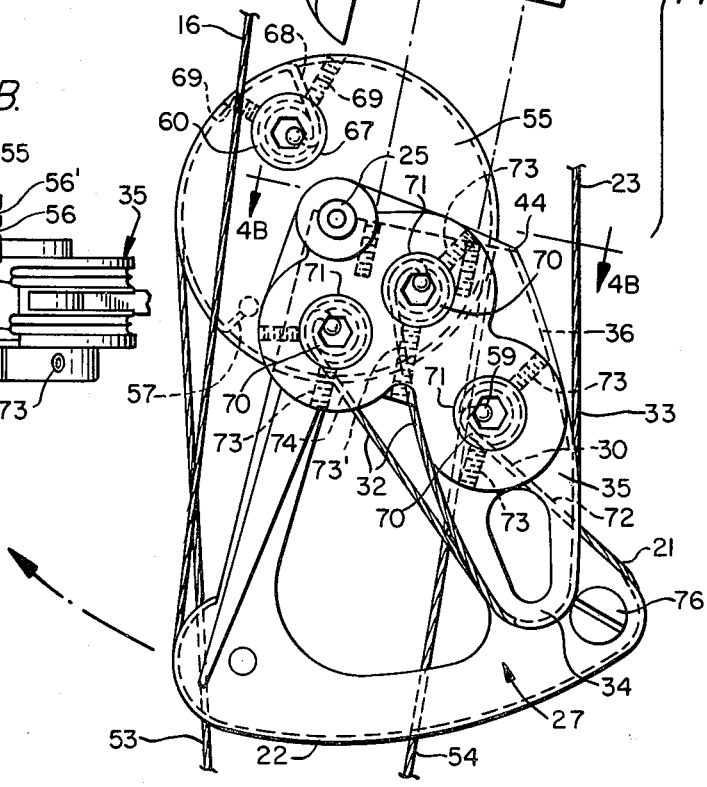

FIG. 8.
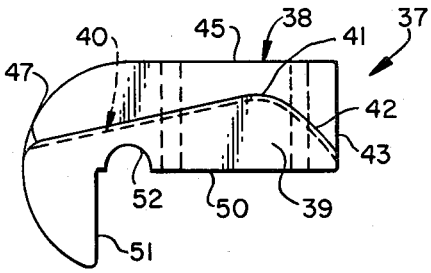
FIG. 9.
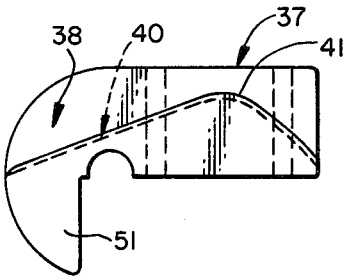
FIG. 10.
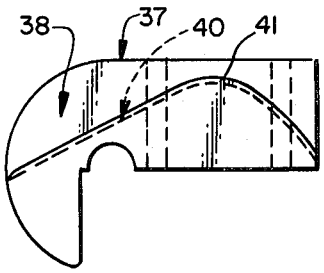
FIG. 11.
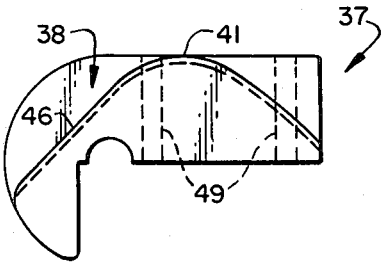
FIG. 12.
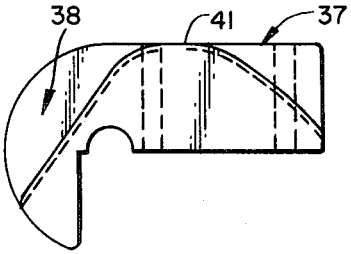
FIG. 13.
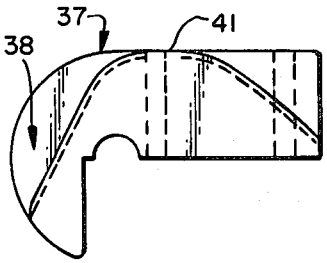
FIG. 14
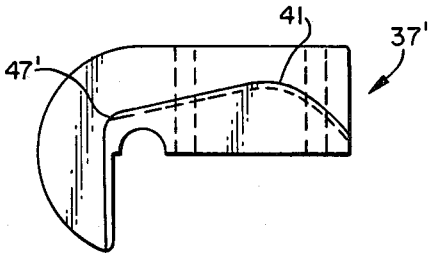
FIG. 15.
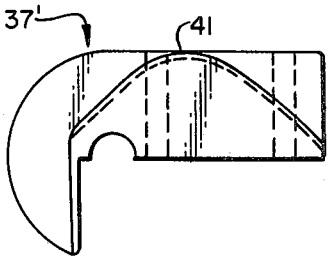
FIG. 16.
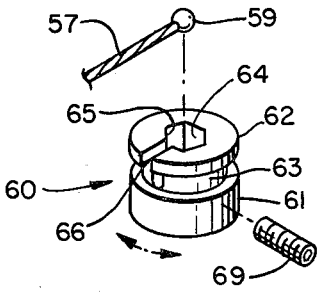
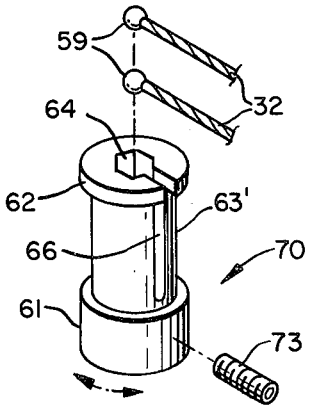
FIG. 17.

COMPOUND BOW

This invention relates generally to archery bows and more particularly to compound bows having unique cam assemblies provided with programed cam segments delivering an improved performance.

As is well known to those skilled in this art, the draw force of a compound bow increases during the early portion of the draw and usually reaches a peak shortly past the mid-point of the draw, after which the draw force continually decreases as the bow is fully drawn, thereby enabling the archer to more readily hold the bowstring and arrow during the critical aiming and release stage. The foregoing action is obtained through the use of one or more pairs of eccentric pulleys and/or cam elements and to date, numerous bows have been produced using various combinations or configurations of these components in attempts at providing compound bows with improved performance.

The paramount factor recognized in evaluating performance of a bow is its speed and this is reflected by the amount of energy stored in the bow during its draw to the fully drawn position. The amount of this stored energy in any one bow may be calculated by plotting a draw force curve as a factor of the draw weight or force of a bow at each point during its draw from brace height to full draw. The available stored energy may be equated to the resultant envelope or area encompassed beneath the draw force curve. The bow which has the capability of storing the greatest amount of energy is the one which has the initial slope of the draw force curve most closely approaching a vertical line and which then holds the greatest amount of draw weight for the greatest possible draw length until let-off.

In other words, the closer the draw force curve approaches the configuration of a rectangle, the greater the amount of stored energy in a particular drawn bow. However, in practice many popular compound bows have exhibited draw force curves wherein the initial or upslope line leading to the peak weight is relatively flat or low angled and terminates or peaks at a point beyond the mid-point of the bow draw length and then rather abruptly drops off to the full drawn length.

By the present invention, a compound bow is provided having cam assemblies with programed cam segments constructed to yield a draw force curve having an upslope line which is relatively steep and reaches the peak weight at a point prior to or no later than the mid-point of the draw length and then maintains the greater part of the peak draw froce for a substantial portion of the continued draw before letting off, such that the net result is noticeably improved amount of stored energy. Among the achieved benefits are: a flatter arrow trajectory and therefore less critical aiming; greater kinetic energy imparted to a given arrow and therefore better penetration; and greater arrow velocity therefore, shorter time of flight and less time for external forces, such as prevailing winds and target movement, to cause deviations from the intended flight path or point of impact.

Examples of compound bows in the prior art will be found in Allen U.S. Pat. No. 3,386,495 dated Dec. 30, 1969 and which employs either eccentric pulleys or shaped cam members affixed to the bow limb tips. U.S. Pat. No. 3,923,035 dated Dec. 2, 1975 and issued to Trotter, involves a compound bow wherein a pair of single cam members are mounted on the handle section of the bow and respectively cooperate with the adjacent bow limb tips each through a unitary string cable/-power cable.

By the present invention, an improved compound bow is presented having a pair of cam assemblies pivotally attached preferably, to a bow handle section with each assembly having a programed string cable segment and a separate power cable cam segment. Included in the power cable segment is a replaceable programed draw length cam module or segment which may be readily removed and replaced by a differently programed module in order to alter one or more parameters of the bow operation. This replacement of the cam module is quickly and easily achieved in the field without having to compress the bow, alter the rigging or disassemble any other components thereof and enables an archer not only to obtain a longer or shorter draw length but also different rates of let-off from peak weight to holding weight. Additionally, different levels of holding weight relative the peak weight may be attained by replacing these modules to provide cable tracks with alternate profiles. Furthermore, the draw force characteristics of a bow after reaching full draw may be altered by the replacement of these cam modules.

Accordingly, one of the objects of the present invention is to provide an improved compound bow having a pair of pivotally mounted cam assemblies each having separate, programed cam segments for a string cable and for at least one power cable.

Another object of the present invention is to provide an improved compound bow having cam assemblies each including a programed cam segment engageable by a power cable with the cam segment including a fixed cable track cooperating with an adjacent replaceable cam track portion.

A further object of the present invention is to provide an improved compound bow including a cam assembly having individual, programed cam segments for separate string and power cables with removable components carried by the cam assembly to adjustably engage and secure at least one free end of both the string cable and power cable.

Still another object of the present invention is to provide an improved compound bow including a pair of cam assemblies carried by the handle section with each assembly including a pair of similarly profiled, programed cam segments respectively engaged by a pair of laterally adjacent power cables leading to an adjacent bow limb tip with a separate string cable engaging another programed cam segment disposed in a vertical plane intermediate the two power cable cam segments and substantially aligned with the plane of the centerline of the bow.

Another object of the present invention is to provide an improved compound bow including a pair of pivotally mounted cam assemblies each including one relatively fixed cam segment engageable by a power cable and cooperating with an adjacent, replaceable cam module having a cable track programed to define a specific draw length.

With these and other objects in view which will more readily appear as the nature of the invention is better understood, the invention consists in the novel construction, combination and arrangement of parts hereinafter more fully, described, illustrated and claimed.

FIG. 3 is an enlarged partial perspective view illustrating one of the cam assemblies of FIG. 1;

FIG. 4 is an exploded side elevation of the cam assembly of FIG. 3;

FIG. 4A is a top plan view of one of the replaceable cam modules taken along the line 4A—4A of FIG. 4;

FIG. 4B is a horizontal sectional view taken along the line 4B—4B of FIG. 4;

FIGS. 8–15 are side elevation views of various replaceable speed/draw length cam modules;

FIG. 16 is an exploded perspective view of a cable adjuster as used to adjustably secure one end of each timing cable; and FIG. 17 is an exploded perspective view of one of the cable adjusters as employed to adjustably secure both free ends of each power cable.

Similar reference characters designate corresponding parts throughout the several figures of the drawings.

Figure 1:
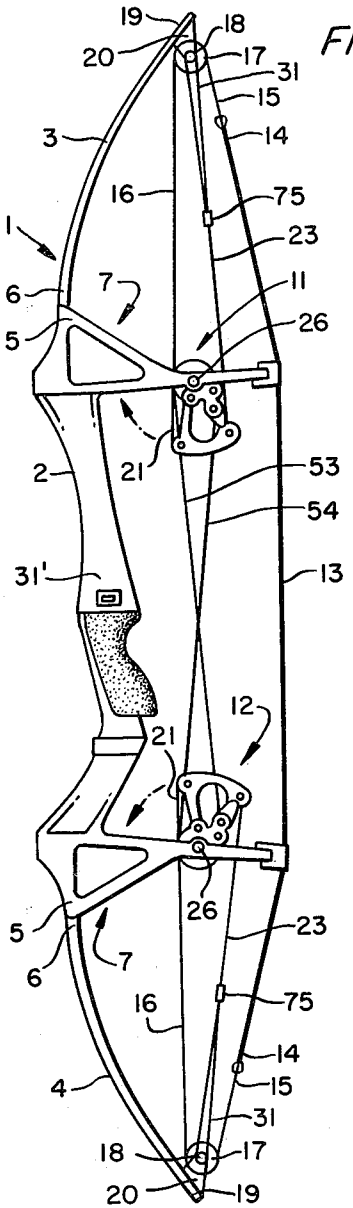
FIG. 1 is a side elevation of a compound bow according to the present invention.
Figure 5:
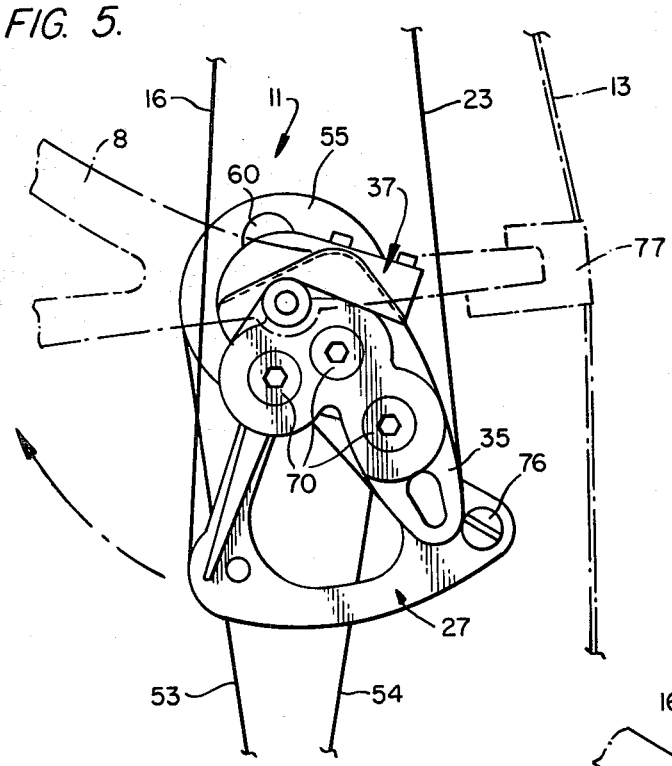
FIG. 5 is an enlarged view of the upper cam assembly of FIG. 1 as it appears in the at-rest position.

Referring now to the drawings, particularly to FIG. 1, the present invention will be seen to relate to a compound bow generally indicated as 1 and which includes a central handle section 2 bounded at opposite ends by a first limb 3 and second limb 4. Although the two limbs and handle section may be formed as a unitary structure preferably, the handle section 2 comprises a separate rigid component having opposite outer ends 5—5 while the limbs 3–4 are constructed of appropriate resilient material with each including an inner end 6 removably and adjustably secured to the respective handle outer ends 5 by any suitable means well known in the art. Projecting from the area adjacent each handle outer end 5 is a cam assembly mount generally designated 7. These mounts are preferably an integral part of the rigid handle section 2 and include a pair of spaced apart side arms 8—8 as shown in FIG. 3 of the drawings. The outer ends of these two side arms 8 are bounded by a transverse end portion 9 such that each mount 7 provides an enclosed vertically extending cam assembly passage 10.

Disposed within each passage 10 is a cam assembly 11 or 12 both of which are identical to one another in so far that each includes the same components although the assemblies are not interchangable since the upper cam assembly 11 and the lower cam assembly 12 are constructed to insure that similar components on the two assemblies are disposed on the same side of the plane of the bow longitudinal center line. However, at a point later on in the description, it will be seen that a description of the details of construction of the upper cam assembly 11 will suffice as it will be understood that the same components thereof exist in the lower cam assembly 12.

Figure 2:
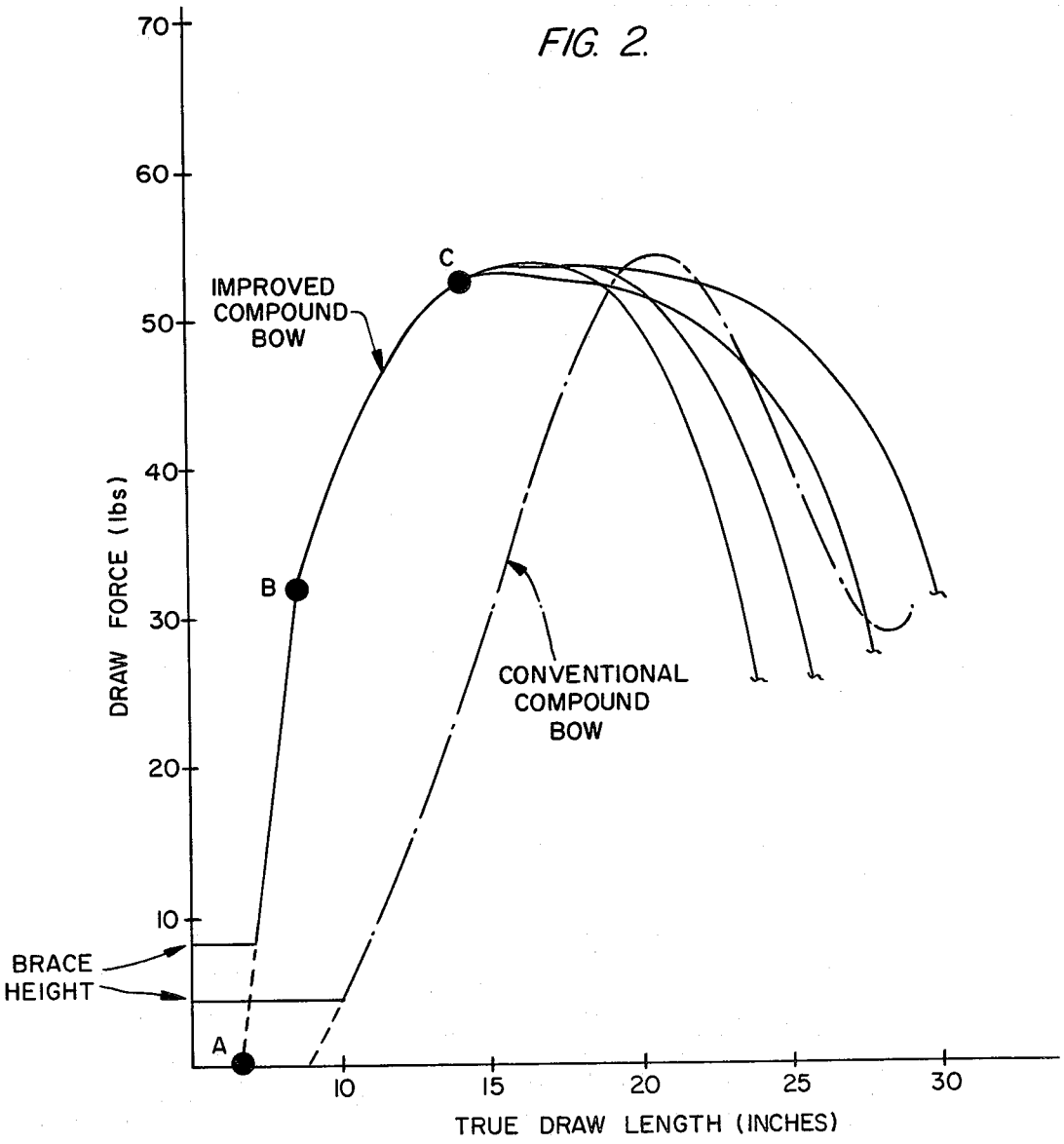
FIG. 2 is a graphical representation illustrating in full lines various draw force curves obtainable with various replaceable cam modules according to the present invention and depicts by a broken line a typical draw force curve as achieved by an existing compound bow.

The cam assemblies 11–12 are constructed to produce as steep an inclination to the upslope line A-B-C of FIG. 2 as possible and to maintain the greatest part of the peak drawing force as long as possible during the continued draw of the bow so as to maximize the area contained beneath the draw force curve in order to secure the greatest amount of stored energy before release of the fully drawn bowstring 13. This bowstring will be seen to extend the majority of the vertical height of the bow 1 and includes ends 14 respectively removably attachable to the draw ends 15—15 of two separate string cables 16—16. Each string cable 16 leads from one bowstring end 14 about a concentric wheel or bearing means 17 rotatably carried by a transverse axle 18 suitable affixed relative the outermost limb tip 19 of the respective limb 3 or 4. The axles 18 are appropriately maintained in a stationary manner with respect to the adjacent limb tip 19 such as by the rigid brackets 20 shown in FIG. 1 of the drawings. Quite obviously, alternate means may be employed to mount the axles 18 such as by providing a pillow block structure (not shown) on the limb tips 19 and forming a split or yoke in the limb tip itself for accommodation of the wheels 17. In any case, the wheels are suitably maintained in alignment with the bow center line.

Each string cable 16 passes from one of the wheels 17 and has its opposite or cam end 21 sheaved about a string cable cam track 22 of the adjacent one of the cam assemblies. The distal portion of this string cable cam end 21 is uniquely adjustably retained and secured within its respective cam assembly as will become apparent hereinafter. As the bowstring 13 is drawn it will follow that the two cam assemblies 11–12 will be displaced respectively in the direction of the arrows of FIG. 1 and the concurrent displacement of these cam assemblies applies a positive deflection to the flexible limbs 3–4 by means of two independent sets of power cables 23 leading from each cam assembly to appropriate bearing means carried by the same axles 18 supporting the string cable wheels 17.

Figure 4C:
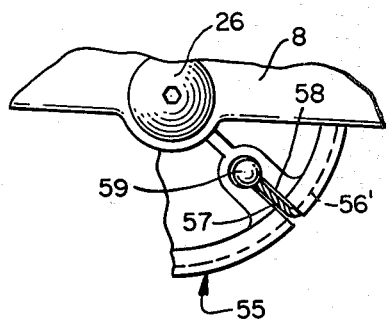
FIG. 4C is a fragmentary side elevation of the reverse side of the timing wheel in the cam assembly of FIG. 4.

Details of the construction of the two cam assemblies 11–12 will be readily apparent from a review of FIGS. 3–4 of the drawings wherein it will be seen that each cam assembly includes a central body mount 24 containing a transverse axle 25 extending from both sides of the cam assembly and suitably affixed to the two spaced apart side arms 8—8 by appropriate mounting fasteners 26. Thus, it will be seen that each entire cam assembly 11 or 12 is mounted for pivotal displacement about the center axis defined by each axle 25 and the respective lateral dimension of the body mount 24 and width of the passage 10 are selected to preclude lateral shifting of the cam assemblies during their pivotal displacement.

The upper cam assembly 11 as shown in FIGS. 3–7 of the drawings includes a first or string cable cam segment 27 which will be seen to be disposed the greatest radial distance from the pivot axis formed by the axle 25. The outer peripheral portion of this first segment 27 includes a sharply radiused leading edge 28 at one end and another sharply radiused trailing edge 29 at its opposite end with the intermeditate portion of this first cam segment 27 comprising a relatively large radius curved member describing an arc of over 45°. A chord subtending these arcs will be seen to extend through the bow handle section 2. The outer periphery of the described first cam segment 27 is medially provided with the string cable track or groove 22 within which the cam end 21 of the string cable 16 is sheaved. The distal portion 30 of the cam end 21 of the string cable is securely anchored within the body of the cam assembly by an arrangement which will be described hereinafter. The vertical plane of the track 22 of the string cable cam segment 27 substantially coincides with the vertical plane passing through both the bow center line and the bowstring and this plane will further be understood to extend forwardly through the sight window 31' of the bow handle section 2 such that upon release of the bowstring 13 from its fully drawn position, any lateral distortion of the released arrow while it is still within the confines of the bow will be discouraged. This latter point is further enhanced inasmuch as the bearing means or wheels 17 about which the string cables pass, will be understood to be disposed within the same vertical plane aligned with the bow center line.

Angular displacement of the two cam assemblies by means of the string cables 16 as above described, is translated as a deflection of the resilient bow limbs 3–4 by means of two sets of tension or power cables 23 leading from each cam assembly to the nearest adjacent bow limb tip 19. Each power cable 23 preferably comprises a single length of cable doubled back upon itself with its intermediate portion 31 looped around one of the bearings or axles 18 and with its two opposite free ends or distal portions 32 adjustably retained and secured within the body of the respective cam assembly by means to be described hereinafter.

Just as the bearing means 18 maintains the string cable positively centered with respect to the limb and bow center line, the loop or end attachment 31 of each power cable 23 is maintained laterally equi-distant this center line. The two cam engaging portions 33 of each power cable are sheaved about the end 34 of a relatively fixed main power cable cam segment 35, the outer periphery of which, is provided with a relatively large radiused track or groove 36 which extends vertically from the cam segment end 34 to a point adjacent the horizontal plane passing through the cam assembly center axis 25 when the assemblies are in the at-rest position as in FIGS. 1 and 5.

As shown most clearly in FIG. 3 of the drawings, the two sets of power cables 23 straddle the medially disposed string cable cam segment 27 and this arrangement, together with the disposition of the loop portion 31 of each power cable set 23 equi-distance from the medially disposed wheel 17, insures that all cables and strings of the compound bow 1 are at all times maintained in a balanced condition with respect to the plane passing through the center line of the bow.

Each twin power cable set 23 cooperates with its own main power cable cam segment 35 and accordingly, it will be understood that the two cam segments 35 of each cam assembly are identically configured and symmetrically arranged with respect to the body of each cam assembly. When the bow is drawn from the at-rest position of FIG. 5 to the partially drawn position of FIG. 6, the string cable 16 has pulled the leading edge 28 of the string cable cam segment 27 a few degrees toward the bow handle section 2 during which time the power cable main cam segment 35 has applied substantial tension upon the power cables 23 and these latter cables are fully sheaved within the tracks 36 of the two main cam segments 35. At this point of the draw, the draw force has almost reached the rated peak weight while the bowstring has not yet been drawn any more than 50% of the bow's draw length. From this point, continued draw causes the power cables 23 to engage and be controlled by a removable speed/draw length cam module or segment 37 located adjacent the pivot axle 25 of each cam assembly 11 and 12.

Each replaceable cam module 37 includes a center mount section 38 substantially aligned with the bow center line and having two oppositely disposed similar side sections 39—39 each having a programed profile including a cable track or groove 40 of sufficient width to accommodate the lateral twin lengths of power cable 23 in each cable set. The distinction between the various cam modules shown in FIGS. 8–15 involves the profile of this track or groove 40 when viewed in side elevation and it will be understood that it is by programming the configuration of this track that any one compound bow equipped with the cam assemblies of the present invention may be readily adapted to various draw lengths, among other parameters.

Figure 6:
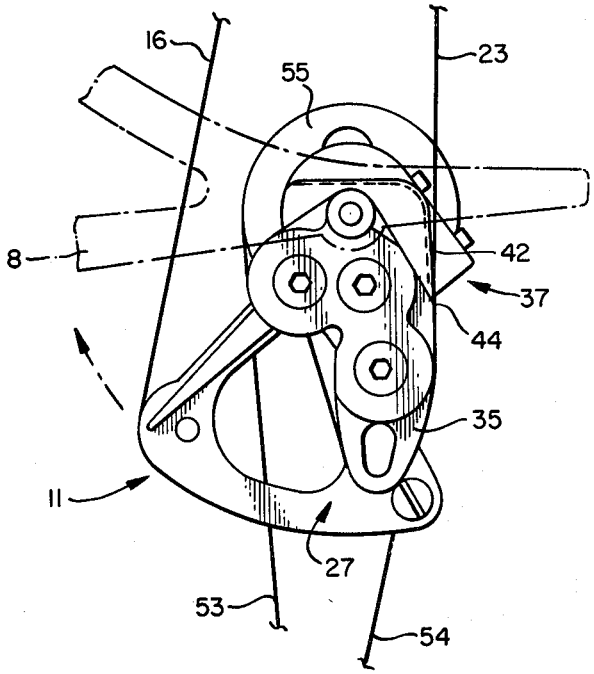
FIG. 6 is a side elevation of the upper cam assembly after the power cables have tracked the main portion of the programed cam segment and are about to enter the track of the replaceable cam module segment.
Figure 7:
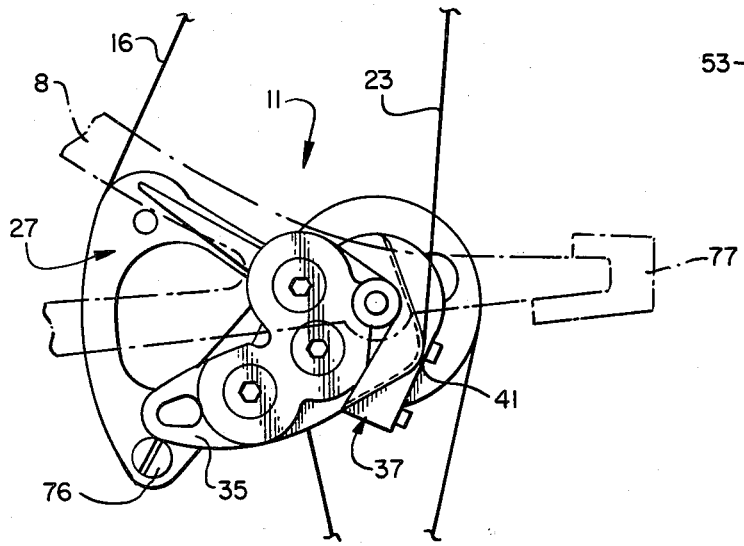
FIG. 7 is a side elevation of the upper cam assembly as it appears with the power cables disosed in the peak draw weight position as determined by the replaceable module tracks.

The peak draw weight is obtained following continued rotation of the cam elements from the position of FIG. 6 to that as shown in FIG. 7 of the drawings. In this latter view, the two sets of power cables 23 are shown engaging the highest peak or knoll 41 of the two cam module guide sections 39—39 such that continued draw of the bow further rotates the cam assembly and initiates the let-off leading to the fully drawn condition. With the foregoing in mind, it will be seen that the initial portion 42 of the module tracks 40 begins at the same point or level with respect to the leading end 43 of the module regardless of which one of the variously configured modules are selected. This is to insure a smooth transition from the trailing end 44 of the track 36 of the main power cable cams 35.

Variation of the draw length is achieved by a combination of altering the elevation of the cam track peak 41 with respect to the module top wall 45 and by altering the inclination of the secondary cam track groove 46. The three modules 37 illustrated in FIGS. 8–10 typically represent configurations applicable to produce draw lengths of 26, 27 and 28 inches respectively, and by a comparison of these figures, it will be seen that as the draw length increases the peak 41 of each cam track rises and the inclination of the secondary portion 46 of the cam track steepens from this peak 41 to the terminal point 47 of the cam track. FIGS. 11–13 illustrate examples of typical cam modules 37 applicable to produce draw lengths of 30, 31 and 32 inches respectively, and in this instance, the longitudinal extent of the peak portion 41 of the cam tracks 40 will be seen to be extended while the inclination of the secondary track 46 is further steepened.

From the above, it will be appreciated that the characteristics of a compound bow equipped with the cam assemblies of the present invention may be readily modified by the mere replacement of cam modules 37 without the necessity of compressing the bow, releasing or disassembling any cables or other components. This replacement involves merely removing two suitable fasteners 48—48 which are disposed through bores 49—49 extending through the center mount section 38 of each cam module. Each module includes a first inner wall 50 normal an adjacent second inner wall 51 and which are adapted to angage a mating configuration in the medial portion of the cam assembly body adjacent the center axle 25 therethrough. An alignment relief or detent 52 such as in the first inner wall 50, further insures a positive placement and retention of each cam module 37 and relieves lateral strain upon the fasteners 48 during use of the bow.

The cam modules 37 shown in FIGS. 14 and 15 indicate modifications of the draw length modules of FIG. 8 and FIG. 11, respectively. The distinction in these latter modifications will be seen to involve a shortening of the secondary cable track 46 so as to move its terminal point 47' close to the vertical plane of the module second inner wall 51. With such an arrangement it will be understood that continued drawing beyond the minimum holding weight position results in a much lower rate of increase in draw force so that the archer may, if desired, slightly overdraw the bow without greatly increasing the holding weight. This differs from the modules of FIGS. 8–13 wherein continuing to draw the bow beyond minimum holding weight results in a rapid rise in draw force or essentially a stop.

Synchronization of the displacement of the two cam assemblies 11 and 12 during use of the bow 1 is assured by means of a pair of separate timing cables 53–54 constantly interconnecting the two cam assemblies. The two opposite ends of each timing cable 53–54 are respectively attached to a timing member or wheel 55 forming a fixed or integral part of each cam assembly and sufficient lateral spacing between the crossing timing cables is assured by having the two ends of each timing cable sheaved within two separate grooves or tracks 56–56' laterally spaced from one another in the periphery of the two timing wheels 55. Thus, although the two cables will be seen to cross when viewed in side elevation, they do not cross laterally of each other since one cable 53 has both its ends attached to the two tracks 56 while the ends of cable 54 are sheaved within the tracks 56'. One fixed end 57 of each timing cable is anchored in a non-adjustable manner to one cable assembly wheel 55 by its insertion within a radial slot 58 and is retained therein by means of the ball head or enlargement 59 which is of greater diameter than the slot 58. The opposite end of this same cable, which crosses over toward the opposite cam assembly is sheaved about one of the grooves on the timing wheel of this other cable assembly and is adjustably retained and secured with respect to the other timing wheel by means of a cable adjuster 60 as shown in FIG. 16.

This cable adjuster comprises a cylindrical member having endmost first and second cylindrical bearing sections 61 and 62 containing therebetween a reduced diameter center section 63. An axial bore 64 extends through the center of the adjuster and contains a tool engaging configuration 65 adjacent at least one of the end bearing sections. A longitudinal slot 66 extends radially through the center section 63 to the axial bore 64 and projects through the second bearing section 62. The cable adjuster 60 is adapted to be slidably inserted within a close-fitting transverse bore 67 provided through the timing wheel 55 at a point which will be readily accessible when the cam assemblies are in the normal or at-rest position of FIGS. 1, 3 and 4. The end of each cable opposite that affixed to one timing wheel by means of the aforedescribed slot 58 is inserted through a radially extending bore 68 communicating from one of the timing wheel tracks 56 or 56' to the transverse bore 67 until the ball head or enlargement 59 thereon is centrally disposed within the timing wheel bore 67 after which the cable adjuster second bearing section 62 is axially inserted into the bore 67 with its longitudinal slot 66 radially aligned with the end of the cable such that when fully inserted within the wheel bore 67 the cable end will be held captive with its enlargement 59 contained within the confines of the adjuster axial bore 64.

When both ends of each of the two timing cables 53 and 54 have been respectively attached as by means of the wheel slot 58 and cable adjuster 60 respectively, then the single cable adjuster 60 associated with each cam assembly 11–12 is rotated in a clockwise manner as shown in FIG. 4 which causes the end of the cable engaged by the adjuster to be wound about the peripheral wall of the reduced diameter center section 63. This rotation is readily accomplished by means of an appropriate hexagonal tool such as an Allen wrench until the proper and equal tension is applied to the two adjustable ends of the timing cables 53–54. Following manipulation of each cable adjuster, it is locked in the tensioned condition by the tightening of a pair of fastener members such as the illustrated set screws 69—69 as shown in FIG. 4. The two set secrews are substantially angularly off-set from one another and are laterally positioned upon the periphery of the timing wheel so as to engage the broader surface presented by the periphery of the first bearing section 61. In this manner, with the fixed end 57 of one timing cable 53, for example, secured to the lower cam assembly 12, the cable proceeds upwardly in a figure eight manner and engages the groove or track 56 in the timing wheel 55 of the upper cam assembly 11 and is anchored thereto by means of the cam adjuster 60. The other timing cable 54 is similarly attached to the cam assemblies but with the manner of attaching its two end portions being reversed such that the cable adjuster 60 for the cable 54 is carried by the timing member 55 of the lower cam assembly 12.

By variably adjusting the respective cable adjusters 60, the two timing cables 53–54 are manipulated until the trailing edges 29 of the cam assemblies are equi-distance with respect to the bowstring and following tightening of the fastener members 69, the secured timing cables will insure equal arcuate displacement of the cam assemblies during draw of the bowstring.

The free ends of the power cables 23 as well as the string cables 16 may be adjustably secured to the respective cam assemblies by cable adjusting means similar to the above described adjusters 60. FIG. 17 of the drawings, illustrates a cable adjuster 70 which is basically similar to the adjuster 60 but includes a substantially longer reduced diameter center section 63'. FIG. 4 most clearly illustrates the adjustable attachment of the various cable ends by means of the use of three of the cable adjusters 70 for each cam assembly 11 or 12. A transverse bore 71 is formed through the central body portion of each cam member for each of the three adjusters 70. The single string cable 16 leading to each cam assembly has its distal portion 30 disposed through a bore 72 communicating with one of the transverse bores 71 located in the area of the main power cable cam segment 35. This cable distal portion 30 is provided with an appropriate construction such as a ball head or enlargement 59 and is retained by means of one of the cable adjusters 70 in the same manner as described hereinabove with respect to the timing cable anchorage. When properly tensioned, the adjuster 70 is secured by means of a pair of set screws 73.

As mentioned earlier, the power cables 23 linking each cam assembly with a respective bow tip actually comprise two adjacent individual cables each doubled back on itself with the medial portion thereof looped as at 31 about the limb tip axle or bearing 18. The two free ends of each power cable 23 are provided with an appropriate ball head or enlargement 59 and are adjustably secured, as in the case of the string cable 16, by one of two power cable adjusters 70 as shown in FIG. 4. The two distal portions 32 of the left-hand most power cable 23 of FIG. 3 are inserted through a single bore 73' to cooperate with one cable adjuster 70 while the two distal portions 32 of the right-hand power cable 23 are inserted through another bore 74 which leads to an additional cable adjuster 70.

Although specific means have been shown in the form of cable adjusters 60,70 allowing securing and adjustability of all of the bow cable ends, it will be appreciated that any suitable other anchorage means may, of course, be utilized. The purpose of employing adjustable securing means is quite obvious to those skilled in the art since means must be available to properly rig or tune a compound bow and to allow the user to remove and replace any damaged cables.

Obviously, a single power cable set could be utilized with the cam assembly of the present invention but this would not achieve the balance so desirable. Likewise, a single length power cable can be used rather than the dual looped lengths disclosed although this may require a larger diameter cable and the required end fastening such as a crimped fitting could interfere with field replacement of the power cables by an archer.

As shown in FIG. 1, a cable retainer or cage 75 engages four lengths of power cables 23 intermediate each cam assembly and bow limb tip. These cable cages serve to not only maintain the two lengths of cables forming each power cable 23 laterally spaced from the other adjacent cable 23 a distance equal to the lateral spacing between the power cable tracks 36—36, but also insure maintenance of an equal and positive transition of both lateral power cables from a disposition parallel to a plane passing from the bowstring to the bow limbs, to a disposition wherein the two lengths of each power cable are disposed in a plane transverse to the face of the bow.

The combination of the specific power cables 23, the cages 75 and the attachment of the opposite ends of the power cables all contribute to a highly desirable symmetrical disposition between the rotating cam elements, all cables and the center line of the bow. Thus, it will be understood that the bowstring 13 and its cable 16 are at all times maintained substantially in alignment with the vertical center line of the bow as is also the string cable cam segment 27 during its displacement. As the bow is drawn, the concurrent flexure and then subsequent release of the limbs is accomplished with a minimum amount of any tendency for the limbs to twist. This is due not only to the aforementioned center line alignment but also due to the symmetrical and balanced arrangement of the two sets of power cables 23—23 associated with each limb tip and adjacent cam assembly.

FIG. 3 of the drawings most clearly illustrates means associated with the power cables 23 to preclude unwanted disengagement between the tracks 36 of the two adjacent power cable cam segments 35 and the respective power cables, such as when one of the associated cable adjusters 70 is being manipulated during rigging of a new power cable retainer 76 or during subsequent tuning thereof. A suitable power cable retainer 76 is carried adjacent the trailing edge 29 of the string cable cam segment 27 and may comprise a removable member projecting from both sides of the cam segment 29 in close proximity to the end 34 of the power cable cam segments 35—35. In this manner, the cables 23 are precluded from jumping the respective tracks 36 in the area of the cam segment ends 34 yet the location of the retainer 76 in no way interferes with the operation of the cam assemblies.

The present bow 1 is configured such that normally the bowstring 13, when in an at-rest taut condition between the two bearing means 17—17, would extend through the same plane as the rear portion of the two cam assemblies 11-12. But with the cam assembly mounts 7, it will be seen, as in FIG. 3, that the two side arms 8 thereof are joined by the transverse end portion 9 thus, precluding the bowstring, when at-rest, from passing any further forward of the rear of the two mounts 7. It is on these transverse end portions 9 that a bumper 77 is mounted. These bumpers are preferably removably attached to the end portions 9 and are constructed of a suitable relatively hard elastomeric composition and are configured to provide a V-way 78 on the rear face thereof. With the above construction, it will be seen that the bowstring 13 never even closely approaches the vertical plane extending between the two limb tip axles 18 and accordingly, when in the at-rest condition of FIGS. 1 and 5, it will be understood that the draw begins at a greater brace height as reflected in the graph of FIG. 2 and thus minimizes the distance the archer must draw the bow to achieve peak weight, in comparison to a conventinal compound bow as reflected by the broken line in FIG. 2.

Alternatively, the cam assemblies of the present invention could be mounted on the limbs 3-4. This would of course, mean the mass of the cam assemblies was carried by the flexing limbs and the power cables would tranverse the area of the arrow location, two disadvantages to be avoided when possible.

Finally, to facilitate the use of the replaceable modules 37-37', it is proposed that each individual module programed according to a specific draw length and/or other parameter, be colored to readily identify that particular module. In this respect, the modules may be colored in their entirety or otherwise marked, such as by a color band or bands.

We claim:

1. A compound bow including, a center handle section, first and second resilient limbs extending from opposite ends of said handle section and each having an outermost tip, upper and lower cam assemblies pivotally attached to said bow, each one of said cam assemblies provided with first and second cam segments, a bowstring having opposite ends and substantially spanning the distance between said limb tips, a pair of string cables each having opposite ends respectively joined to each said bowstring end and one of said cam assemblies, one said end of each said string cable having a cam engaging portion sheaved about one said first cam segment, a pair of power cables each having opposite ends respectively joined adjacent one said limb tip and one of said cam assemblies, one said end of each said power cable having a cam engaging portion sheaved about one said second cam segment, and one of a plurality of different sized speed/draw length replaceable cam modules attached to each of said cam assemblies adjacent to and in the same vertical plane as each said second cam segment whereby, as said bowstring is drawn from an at-rest condition said string cables pivotally displace said cam assemblies through said engagement of said string cables with said first cam segments while concurrently said second cam segments initially apply tension to respective ones of said power cables and with further rotation of the cam assembly a full bow draw length is achieved as said power cables are subsequently sheaved about preselected ones of said cam modules.

2. A compound bow according to claim 1 wherein, said cam assemblies are disposed on said bow along a line extending between said limb outermost tips when said bow is in an at-rest condition.

3. A compound bow according to claim 1 wherein said bowstring and string cables are disposed substantially in a common forwardly extending vertical plane passing through the center longitudinal axis of said bow handle section and limbs and remain in said plane during said pivotal displacement of said cam assemblies as said bow is drawn.

4. A compound bow according to claim 1 including, a pair of said second cam segments on each said cam assembly one each in vertical planes on opposite sides of each said first cam segment.

5. A compound bow according to claim 4 wherein, said power cable sheaved about each said second cam segment comprises a separate single length cable doubled back to provide a pair of parallel ones of said power cable cam engaging portions and said power cable end joined adjacent said limb tip comprises an intermediate loop portion of said single length cable.

6. A compound bow according to claim 4 including, a cable track in each said second cam segment for receiving said sheaved power cable, and removable retainer means carried by each said first cam segment and overlying said power cables sheaved about said second cam segments to prevent jumping of said power cables from said cable tracks.

7. A compound bow according to claim 4 including, at least a pair of laterally spaced apart ones of said power cables engaging each said cam assembly, each said cam module including a pair of laterally spaced apart similarly profiled cable tracks separated by a center mount section, and each said cable track vertically aligned with one said second cam segment of each said cam assembly.

8. A compound bow according to claim 1 including, a concentrical disposed timing wheel integral with each said cam assembly, and a timing cable having opposite ends sheaved about said timing wheels.

9. A compound bow according to claim 8 including, a pair of separate ones of said timing cables extending in a crossing manner between said timing wheels, each one of said timing cables having one end non-adustably anchored to a respective one of said timing wheels, and cable adjuster means carried by each said timing wheel and adjustably anchoring the opposite end of each said timing cable.

10. A compound bow according to claim 8 including, a sight window in said handle section, and said timing wheels and timing cable disposed in a forwardly extending vertical plane laterally removed from the vertical plane extending from said bowstring through said sight window.

11. A compound bow according to claim 1 wherein, each said cam assembly includes a central body mount, transverse means through said body mounts pivotally attaching said cam assemblies to said bow, and releasable fastener means carried by each said cam module and insertable in said body mount.

12. A compound bow according to claim 11 wherein, said cam modules are attached to said cam assemblies in a position clear of engagement by all said cables when said bow is in an at-rest condition whereby, said cam modules may be removed and replaced with alternate ones of said cam modules without unstringing said cables.

13. A compound bow according to claim 1 wherein, said handle section is provided with opposite outer ends, substantially stationary bumper means extending rearwardly from said handle outer ends, said bumper means in a plane disposed rearwardly of a line joining said limb tips whereby, with said bow in an at-rest condition at least a central portion of said bowstring engages and spans said bumper means in a vertical plane substantially rearwardly of said line joining said limb tips.

14. A compound bow according to claim 13 including, rigid cam assembly mounts extending rearwardly from said handle section outer ends toward said bowstring, said mounts having a transverse end portion, and said bumper means comprising resilient bumpers removably attached to said transverse end portions.

15. A compound bow according to claim 1 including, a plurality of rotatable transversely disposed cable adjusters carried by each said cam assembly, means on each said cable adjuster respectively releasably engaging said opposite ends of said string cable and power cables whereby, an angular adjustment of selected ones of said adjusters varies the tension applied to the respectively engaged cable, and manipulative lock means carried by each said cam assembly engageable with each said adjuster to secure its adjusted angular position.

16. A compound bow according to claim 15 wherein, each said cable adjuster includes a substantially cylindrical member having an axial bore, a reduced diameter center section provided with a longitudinal slot communicating with said bore, anchor means on the distal portion of said cable opposite ends insertable within said bores as said cable opposite ends are inserted within said slots, and said bore provided with tool-engageable means permitting rotation of said adjusters whereby, said cable opposite ends are wound around said reduced diameter center sections to obtain proper cable tension prior to securing said adjusters by manipulation of said lock means.

17. A compound bow according to claim 1 wherein, each said replaceable cam module includes a cable track comprising initial and secondary cable track portions joined by an intermediate cable track peak portion whereby, as said cam assemblies are pivotably displaced during drawing of said bowstring, said power cables are first sheaved within said initial track portions and with the bow drawn to its full weight said cables are sheaved within said cable track peak portions.

18. A compound bow according to claim 17 wherein, each said cam module cable track in side elevation defines a generally V-shaped configuration with said initial and secondary track portions substantially straight and said intermediate peak portion generally curved whereby, the length and angular relationship between said initial and secondary track portions determines the draw weight and let-off of said bow.

19. A compound bow according to claim 1 wherein, said handle section is provided with opposite outer ends, a cam assembly mount extending rearwardly from each said handle section outer end toward said bowstring and said cam assemblies respectively pivotally attached to said mounts.

20. A compound bow according to claim 19 wherein, said cam assemblies are attached to said mounts along a line extending between said limb outermost tips when said bow is in an at-rest condition.

21. A compound bow according to claim 1 wherein, said cam assembly first and second cam segments are displaced in a direction toward said handle section during said pivotal displacement of said cam assemblies as said bowstring is drawn from an at-rest condition.

22. A compound bow including, a center handle section, first and second resilient limbs extending from opposite ends of said handle section and each having an outermost tip, upper and lower cam assemblies pivotally attached to said bow, each one of said cam assemblies provided with first and second cam segements, a pair of said second cam segments on each said cam assembly one each in vertical planes on opposite sides of each said first cam segment, a bowstring having opposite ends and substantially spanning the distance between said limb tips, a pair of string cables each having opposite ends respectively joined to each said bowstring end and one of said cam assemblies, one said end of each said string cable having a cam engaging portion sheaved about one said first cam segment, a pair of power cables each having opposite ends respectively joined adjacent one said limb tip and one of said cam assemblies, one said end of each said power cable having a cam engaging portion sheaved about one said second cam segment, and one of a plurality of different sized speed/draw length replaceable cam modules attached to each of said cam assemblies adjacent to each said second cam segment whereby, as said bowstring is drawn from an at-rest condition said string cables pivotally displace said cam assemblies through said engagement of said string cables with said first cam segments while concurrently said second cam segments initially apply tension to respective ones of said power cables and with further rotation of the cam assembly a full bow draw length is achieved as said power cables are subsequently sheaved about preselected ones of said cam modules.

* * * * *

UNITED STATES PATENT AND TRADEMARK OFFICE

CERTIFICATE OF CORRECTION

PATENT NO. : 4,461,267

DATED : July 24, 1984

INVENTOR(S) : GARY SIMONDS ET AL

It is certified that error appears in the above-identified patent and that said Letters Patent are hereby corrected as shown below:

On the title page, item [73] should read as follower:

-- [73] Assignee: Kidde Recreation Products, Inc.
Northbrook, Illinois --.

Signed and Sealed this

*Third* Day of *September 1985*

[SEAL]

*Attest:*

DONALD J. QUIGG

*Attesting Officer* *Acting Commissioner of Patents and Trademarks - Designate*